US007963792B2

(12) United States Patent
Sawada et al.

(10) Patent No.: US 7,963,792 B2
(45) Date of Patent: Jun. 21, 2011

(54) PLUG DETACHMENT PREVENTION STRUCTURE

(75) Inventors: Shigeru Sawada, Hamamatsu (JP); Kazuhiko Matsuoka, Hamamatsu (JP)

(73) Assignee: Roland Corporation, Shizuoka-ken (JP)

( * ) Notice: Subject to any disclaimer, the term of this patent is extended or adjusted under 35 U.S.C. 154(b) by 0 days.

(21) Appl. No.: 12/785,342

(22) Filed: May 21, 2010

(65) Prior Publication Data

US 2011/0053402 A1 Mar. 3, 2011

(30) Foreign Application Priority Data

Aug. 31, 2009 (JP) ..... 2009-200926

(51) Int. Cl.
*H01R 13/625* (2006.01)
*H01R 4/50* (2006.01)

(52) U.S. Cl. ..... 439/345; 439/373; 439/352

(58) Field of Classification Search ..... 439/345, 439/373, 352, 365

See application file for complete search history.

(56) References Cited

U.S. PATENT DOCUMENTS 4,768,974 A * 9/1988 Cowan et al. ..... 439/371

FOREIGN PATENT DOCUMENTS

JP 61-79474 5/1986

OTHER PUBLICATIONS

English translation of JP 61079474, publication date May 27, 1986.

* cited by examiner

*Primary Examiner* — Javaid Nasri
(74) *Attorney, Agent, or Firm* — David W. Victor; Konrad Raynes & Victor LLP

(57) ABSTRACT

Provided is a plug detachment prevention structure, such that when a plug equipped with a plug terminal and a plug retaining section that covers a part of the plug terminal is connected to a jack provided inside a housing, the plug detachment prevention structure retains the plug retaining section to prevent the plug from detaching from the jack, wherein the plug detachment prevention structure is equipped with a ring-shaped elastic section composed of an elastic material in which the plug retaining section is pressure-inserted, and a frame section that is circularly mounted at an outer circumferential side of the elastic section, composed of a material harder than that of the elastic section and detachably attached on an outside of the housing.

20 Claims, 7 Drawing Sheets

PLUG DETACHMENT PREVENTION STRUCTURE

CROSS-REFERENCE TO RELATED FOREIGN APPLICATION

This application is a non-provisional application that claims priority benefits 5 under Title 35, Unites States Code, Section 119(a)-(d) from Japanese Patent Application entitled "PLUG DETACHMENT PREVENTION STRUCTURE" by Shigeru SAWADA and Kazuhiko MATSUOKA, having Japanese Patent Application Serial No. 2009-200926, filed on Aug. 31, 2009, which Japanese Patent Application is incorporated herein by reference in its entirety.

BACKGROUND OF THE INVENTION

1. Field of the Invention

The present invention relates to plug detachment prevention structures and, in particular, to plug detachment prevention structures that can provide greater tolerance for assembling accuracy among parts including plugs and jacks, as well as improve their general applicability.

2. Description of the Related Art

It is generally known that transmission of electrical signals between one electrical device and another electrical device is conventionally performed through coupling a plug provided on the one electrical device to a jack provided on the other electrical device.

However, due to manufacturing errors in the manufacturing stage, or wear and tear of the plug or the jack through repeated use, the connection between the plug and the jack may become loose, which may eventually cause the plug to be readily detached from the jack. In this connection, a technology has been provided to make it harder for the plug to detach from the jack through fixing the plug to a housing in which the jack is stored.

For example, Japanese Laid-open Utility Model application SHO 61-79474 describes a plug attaching structure (a plug detachment prevention structure). The plug attaching structure is formed in a portion of a main body (housing) composed of synthetic resin, and has an elastic receiving section in a ring shape and a punched-out portion around the ring shaped receiving section, wherein the receiving section has a cut portion cut therein having a predetermined gap, and a link section generally on the opposite side of the cut section and connected to the main body, and wherein the elastic receiving section has an inner diameter that is smaller than an outer diameter of a plug.

SUMMARY

A plug detachment prevention structure is provided such that, when a plug equipped with a plug terminal and a plug retaining section that covers a part of the plug terminal is connected to a jack provided inside a housing, the plug detachment prevention structure retains the plug retaining section to prevent the plug from detaching from the jack, wherein the plug detachment prevention structure is equipped with a ring-shaped elastic section composed of an elastic material in which the plug retaining section is pressure-inserted, and a frame section that is circularly mounted at an outer circumferential side of the elastic section, composed of a material harder than that of the elastic section and detachably attached on an outside of the housing.

In accordance with further embodiments of the plug detachment prevention structure recited, the elastic section is equipped with a plurality of elastic protrusions that protrude from its inner circumferential surface side in a radial inward direction and are brought in pressure contact with an outer circumferential surface of the plug retaining section, and a plurality of elastic non-protruded sections, each being formed between adjacent ones of the elastic protrusions as viewed in an axial direction, and having concave end sections wherein a virtual circle connecting the concave end sections has a greater diameter than a diameter of a retaining section virtual circle that is a virtual circle connecting outermost exterior portions of the plug retaining section.

In accordance with further embodiments of the plug detachment prevention structure, the frame section is equipped with a first restriction wall that protrudes from its inner circumferential side in a radial inward direction, and is abutted against a bottom surface of the elastic section on its installation surface side to the housing.

In accordance with further embodiments of the plug detachment prevention structure, a plurality of the first restriction walls is formed in a circumferential direction at predetermined intervals, wherein the plurality of first restriction walls are formed at positions matching in phase with the plurality of elastic non-protruded sections in the circumferential direction.

In accordance with further embodiments of the plug detachment prevention structure, the frame section is equipped with a second restriction wall that is formed on the outer circumferential side of the elastic section as viewed in an axial direction, wherein portions thereof matching in phase with the plurality of elastic non-protruded sections in the circumferential direction are more receded than portions thereof matching in phase with the plurality of elastic protrusions in the circumferential direction.

In accordance with further embodiments of the plug detachment prevention structure, the elastic section has a gap having a predetermined separation between the elastic protrusions and the second restriction wall.

In accordance with further embodiments of the plug detachment prevention structure, the elastic section is formed such that, among virtual circles connecting convex end sections of the elastic protrusions, a first opening that is an opening for pressure-insertion of the plug has an inner diameter formed greater than that of the retaining section virtual circle, and among the virtual circles connecting the convex end sections of the elastic protrusions, a second opening on the side thereof to be attached to the housing has an inner diameter smaller than that of the retaining section virtual circle, and greater than an outer diameter of the plug terminal, wherein the virtual circles connecting the convex end sections of the elastic protrusions gradually become smaller from the first opening toward the second opening.

In accordance with further embodiments of the plug detachment prevention structure recited, the elastic section is equipped with a first pressure-insertion aperture formed at a position including the first opening, and a second pressure-insertion aperture continuous with the first pressure-insertion aperture and formed at a position including the second opening, wherein the rate of gradual reduction in the inner diameter of the second pressure-insertion aperture is smaller than the rate of gradual reduction in the inner diameter of the first pressure-insertion aperture, and the inner diameter at a connection section between the first pressure-insertion aperture and the second pressure-insertion aperture is formed to be smaller than that of the retaining section virtual circle.

In accordance with further embodiments of the plug detachment prevention structure, the elastic section is formed to have a length longer in the axial direction in the second pressure-insertion aperture than a length in the axial direction in the first pressure-insertion aperture.

DETAILED DESCRIPTION

Figures 1A, 1B:
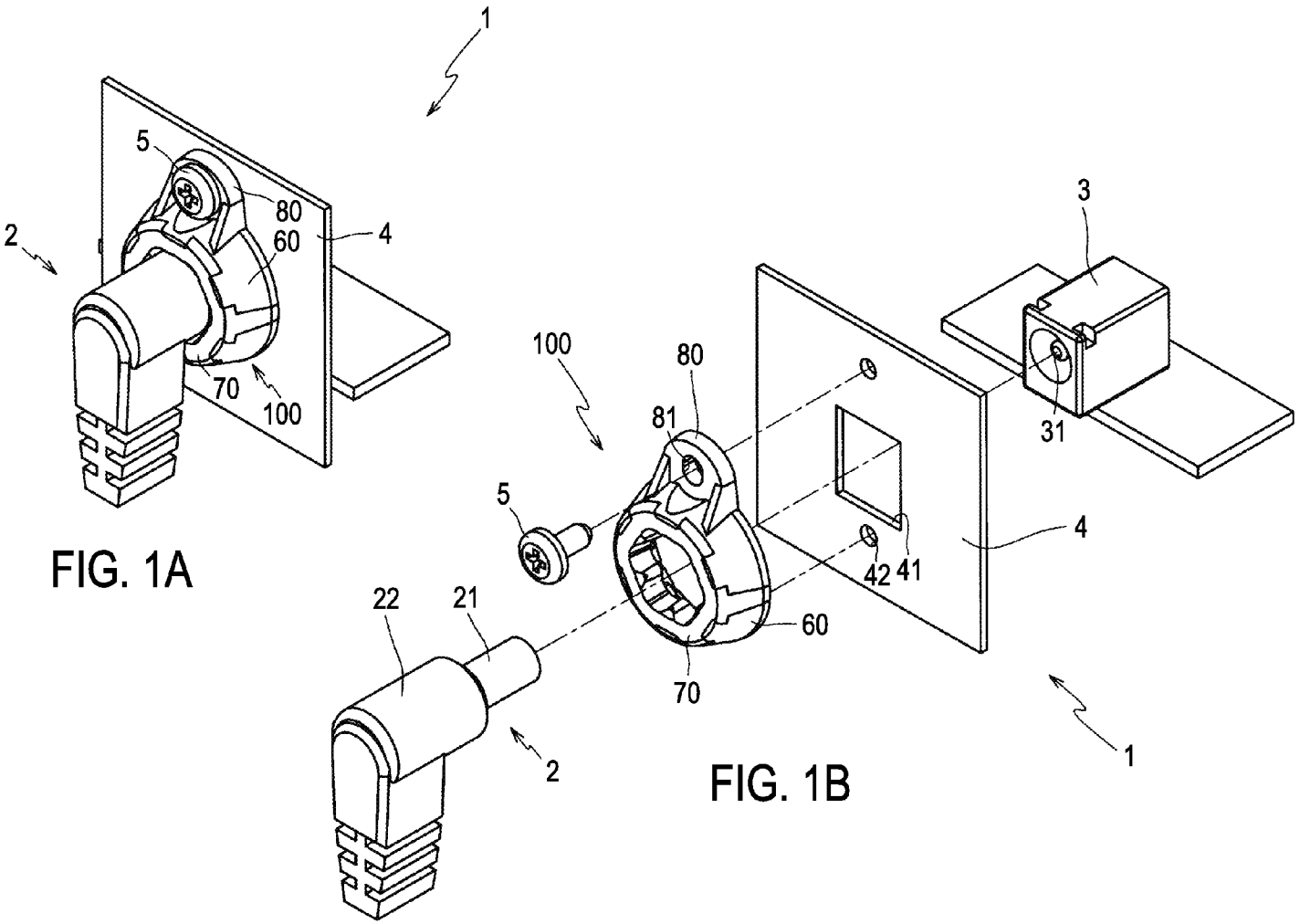
FIG. 1(*a*) is a perspective view of a plug detachment prevention structure in accordance with a first embodiment of the invention, and FIG. 1(*b*) is an exploded perspective view of the plug detachment prevention structure.

According to the conventional plug attaching structure described above, the elastic receiving section is formed in the main body composed of synthetic resin. Synthetic resin is more difficult to elastically deform, compared to elastic material such as rubber. Therefore, if an error is present in coaxiality among the elastic receiving section, the plug and the jack, there is a possibility in that the plug cannot be connected to the jack, or the elastic receiving section may be damaged if the plug is forcefully connected to the jack. Therefore, when the plug attaching structure is formed in the housing, highly accurate coaxiality is required among the elastic receiving section, the plug and the jack, which leads to a problem in that very strict assembling accuracy needs to be set among parts including the elastic receiving section, the plug and the jack. Moreover, as the elastic receiving section is formed in a part of the housing, the elastic receiving section may need to be re-designed depending on the structure of an electrical device stored in the main body, which lowers its applicability.

The described embodiments provide a plug detachment prevention structure that can provide greater tolerance for assembling accuracy among parts including a plug and a jack, and improve its general applicability.

The plug detachment prevention structure of the described embodiments is equipped with the ring-shaped elastic section composed of the elastic material in which the plug retaining section is pressure-inserted, by pressure-inserting the plug retaining section in the elastic section when connecting the plug with the jack, the elastic section can be elastically deformed. Therefore, the plug retaining section is brought in pressure contact with the elastic section by the elastic force of the elastic section, such that the plug retaining section can be securely retained, and disconnection of the plug from the jack against the will of the user can be suppressed.

Also, as the frame section is circularly mounted on the outer circumference side of the elastic section, this is effective in that the elastic section can be more strongly retained as the frame section is attached to the housing, compared to the case where the elastic section were to be attached to the housing. It is noted that, when the frame section is attached to the housing, and when an error is present in coaxial accuracy among the elastic section, the plug and the jack, the elastic section may be elastically deformed thereby correcting the error in the coaxiality, whereby a tolerance can be given for assembling accuracy among the parts including the plug and the jack. Accordingly, it is not necessary to set the coaxial accuracy to a high degree at the time of attaching the frame section, such that the frame section can be effectively attached.

Moreover, as the frame section is attached to the outside of the housing, the frame section can be installed, irrespective of the arrangement of parts composing the electrical device that is stored in the housing. Therefore, the frame section can be installed not only in the manufacturing stage of a product, but also after completion of the product, which is effective in improving its applicability. Also, even when the user does not have expert knowledge about the electric device stored in the housing, the user himself can remove the frame section according to the user's preference.

Moreover, as the elastic section is composed of an elastic material, such that its plastic deformation would not readily occur even after repeated use, compared to the case where the corresponding part is composed of synthetic resin. This is effective in that the retaining force of the plug retaining section can be maintained for a longer time.

The plug detachment prevention structure of the described embodiments includes an elastic section equipped with the plurality of elastic protrusions that protrude from its inner circumferential surface side in a radial inward direction and are brought in pressure contact with the outer circumferential surface of the plug retaining section, and the plurality of elastic non-protruded sections, each being formed between adjacent ones of the elastic protrusions as viewed in an axial direction, and having the concave end sections wherein a virtual circle connecting the concave end sections has a greater diameter than a diameter of a retaining section virtual circle that is a virtual circle connecting outermost peripheral portions of the plug retaining section. Therefore the elastic protrusions can be elastically deformed toward sides where the elastic non-protruded sections.

More specifically, when the plug retaining section is pressure-inserted in the elastic section, the outer circumferential surface of the plug retaining section is brought in pressure contact with the elastic protrusions. In this instance, the elastic non-protruded sections each formed between adjacent ones of the elastic protrusions as viewed in an axial direction are not brought in pressure contact with the outer circumferential surface of the plug retaining section, such that a space is formed between adjacent ones of the elastic protrusions. Therefore, when the plug retaining section is fixed under pressure contact with the elastic section, the elastic protrusions would readily elastically deform to the sides where the elastic non-protruded sections are arranged, which is effective in that a wider range can be secured accordingly for correction of errors in coaxiality among the elastic section, the plug and the jack.

The plug detachment prevention structure of the described embodiments may further include a frame section equipped with the first restriction wall that protrudes from the inner circumferential side in a radial inward direction, and is abutted against the bottom surface of the elastic section on its installation surface side to the housing. Therefore, when the plug retaining section is pressure-inserted in the elastic section, the amount of elastic deformation of the elastic section toward the housing side can be restricted by the first restriction wall. In other words, when the elastic section elastically deforms toward the housing side, the restoring force of the elastic section acts as a force that pushes back the plug terminal connected to the jack to the side of the plug retaining section. In contrast, in accordance with the described embodiments, the amount of elastic deformation of the elastic section toward the housing side is restricted by the first restriction wall, such that the restoring force of the elastic section can be suppressed accordingly, which is effective in preventing the plug from separating from the jack.

Also, when the elastic section and the frame section are bonded together, the bottom surface of the elastic section on its installation surface side to the housing and the first restriction wall can be bonded together. Therefore, a wider bonding area can be secured between the elastic section and the frame section, which is effective in more securely fixing the elastic section to the frame section.

In further embodiments of the plug detachment prevention structure, as the plurality of the first restriction walls is formed in a circumferential direction at predetermined intervals, wherein the plurality of first restriction walls are formed at positions matching in phase with the plurality of elastic non-protruded sections in the circumferential direction, restriction of elastic deformation of the elastic protrusions by the first restriction walls can be prevented. Therefore, when the plug retaining section is pressure-inserted in the elastic section, elastic deformation of the elastic section toward the housing side is restricted, while the elastic protrusions are allowed to be readily elastically deformed, thereby securely fixing the plug retaining section by pressure contact.

In further embodiments of the plug detachment prevention structure, the frame section is equipped with the second restriction wall that is formed on the outer circumferential side of the elastic section as viewed in an axial direction, wherein portions thereof matching in phase with the plurality of elastic non-protruded sections in the circumferential direction are receded more than portions thereof matching in phase with the plurality of elastic protrusions in the circumferential direction, such that, by adjusting the length of the second restriction wall in the radial direction, the protrusion length (convex length or concave depth) of the elastic protrusions in the radial inward direction can be made shorter. On the other hand, the second restriction wall is provided with the receded portions matching in phase with the plurality of the elastic non-protruded sections in the circumferential direction, such that the elastic protrusions are allowed to be readily elastically deformed to the sides where the elastic non-protruded sections. This is accordingly effective in that the elastic protrusions are made to be more readily elastically deformed, and the retaining force by the elastic section to retain the plug retaining section can be readily adjusted by adjusting the length of the second restriction wall in the radial direction.

Further, the second restriction wall has the portions matching in phase with the plurality of elastic non-protruded sections in the circumferential direction, such that, when the elastic section is bonded to the frame section, a wider bonding area between the second restriction wall and the outer circumferential surface of the elastic section can be secured, whereby the elastic section can be more securely fixed to the frame section.

In further embodiments of the plug detachment prevention structure, as the elastic section has a gap having a predetermined separation formed between the elastic protrusions and the second restriction wall, the readiness of elastic deformation of the elastic protrusions in the radial direction can be divided in two stages.

More specifically, in an initial stage of pressure-insertion of the plug retaining section into the elastic section, deformation of the elastic protrusions in the radial direction is not restricted by the second restriction wall because the gap is formed between the elastic protrusions and the second restriction wall, whereby the elastic protrusions can be readily deformed in the radial direction, which makes it easier for the plug retaining section be to pressure-inserted in the elastic section. Thereafter, when the plug retaining section is pressure-inserted in the elastic section, and the elastic protrusions are deformed in the radial direction by a predetermined amount, the gap between the elastic protrusions and the second restriction wall is eliminated and the elastic protrusions are brought in contact with the second restriction wall. As a result, as the plug retaining section is retained by the elastic section through pressure contact, elastic deformation of the elastic protrusions in the radial direction can be restricted, whereby the plug retaining section can be securely retained through pressure contact.

In further embodiments of the plug detachment prevention structure, the elastic section is formed such that, among virtual circles connecting convex end sections of the elastic protrusions, a first opening that is an opening for pressure-insertion of the plug has an inner diameter formed to be greater than that of the retaining section virtual circle. This makes it difficult for the end face of the plug retaining section to contact a peripheral section of the first opening, when the plug retaining section is pressure-inserted in the elastic section. This is therefore effective in suppressing damage that may be inflicted on the peripheral section of the first opening due to contact with the plug retaining section.

Moreover, among the virtual circles connecting the convex end sections of the elastic protrusions, a second opening on the side thereof to be attached to the housing has an inner diameter smaller than that of the retaining section virtual circle, and greater than an outer diameter of the plug terminal, the plug retaining section can be securely retained through pressure contact by the elastic protrusions between the portion thereof where the diameter of the virtual circle connecting the convex end sections of the elastic protrusions is smaller than the outer diameter of the plug retaining section and the portion of the second opening.

Furthermore, the virtual circle connecting the convex end sections of the elastic protrusions gradually become smaller from the first opening toward the second opening, which makes it possible to reduce the stress on the elastic protrusions which is caused when the elastic protrusions are pressed against the end face of the plug retaining section.

In other words, for example, when the virtual circles connecting the convex end sections of the elastic protrusions are formed with a portion with a first diameter that is the same as the inner diameter of the first opening and a portion with a second diameter that is another diameter that is the same as the inner diameter of the second opening, a connecting surface between the portion with the first diameter and the portion with the second diameter faces in a direction opposing the first opening. Therefore, when the end face of the plug retaining section is pressed against the elastic protrusions, the stress on the connecting surface of the elastic protrusions may become substantial, which would likely damage the elastic protrusions. In contrast, in accordance with the described embodiments, the diameter of the virtual circle connecting the convex end sections of the elastic protrusions gradually reduces from the first opening toward the second opening, such that the stress on the elastic protrusions generated upon pressing the end face of the plug retaining section against the elastic protrusions can be reduced, whereby the elastic protrusions are made more difficult to be damaged.

In further embodiments of the plug detachment prevention structure, the elastic section is equipped with a first pressure-insertion aperture formed at a position including the first opening, and a second pressure-insertion aperture continuous with the first pressure-insertion aperture and formed at a position including the second opening, wherein the rate of gradual reduction in the inner diameter of the second pressure-insertion aperture is smaller than the rate of gradual reduction in the inner diameter of the first pressure-insertion aperture, and the inner diameter at a connection section between the first pressure-insertion aperture and the second pressure-insertion aperture is formed to be smaller than that of the retaining section virtual circle. Accordingly, a wider contact area can be secured between the plug retaining section and the inner circumferential surface of the elastic section, compared to the case where the inner diameter is gradually reduced at a constant rate from the first opening to the second opening.

In other words, compared to the case where the opening area of the first opening and the opening area of the second opening are made in the same sizes as those of the described embodiments, and the diameter is gradually reduced at a constant rate from the first opening to the second opening, the described embodiments can provide the following effect. Namely, as the second pressure-insertion aperture smaller than the retaining section virtual circle is formed, a greater contact area between the plug retaining section and the elastic protrusions can be secured to a corresponding degree, compared to the case where the diameter is gradually reduced at a constant rate from the first opening to the second opening. Therefore, this embodiment is effective in that the first pressure-insertion aperture makes the end face of the plug retaining section more difficult to contact the peripheral section of the first opening, and the second pressure-insertion aperture can more securely retain the plug retaining section through pressure contact.

In further embodiments of the plug detachment prevention structure recited, the elastic section is formed to have a length longer in the axial direction in the second pressure-insertion aperture than a length in the axial direction in the first pressure-insertion aperture, a wider contact area can be secured between the plug retaining section and the elastic protrusions, compared to the case where the length of the second pressure-insertion aperture in the axial direction is shorter than the length of the first pressure-insertion aperture.

The embodiments will be described with reference to the accompanying drawings. FIG. 1(*a*) is a perspective view of a plug detachment prevention structure 1 in accordance with a first embodiment, and FIG. 1(*b*) is an exploded perspective view of the plug detachment prevention structure 1. First, referring to FIG. 1, an outline of the structure of the plug detachment prevention structure 1 and a plug fastener 100 will be described.

As shown in FIG. 1(*a*) and FIG. 1(*b*), according to the plug detachment prevention structure 1, a plug 2 that is to be connected to a jack 3 is retained through pressure contact by the plug fastener 100 that is attached to an exterior portion of a housing 4, thereby suppressing detachment of the plug 2 from the jack 3 inadvertently, against the will of the user, for example, due to some accident in which a connection cable (not shown) of the plug 2 is caught by an obstacle or the like.

The plug 2 is a member for electrically connecting the connection cable to an electrical device (not shown), and is primarily equipped with a plug terminal 21 that is inserted in the jack 3 and is made of conductive material, and a plug retaining section 22 that is composed of insulation material and covers a portion of the plug terminal 21. The jack 3 is equipped with a jack terminal 31 that is coupled to the plug terminal 21. The housing 4 is a box-like member that contains the electric device, and is equipped with a jack insertion-mounting hole 41 through which a front surface side of the jack 3 is inserted and mounted. The jack 3 is stored inside the housing 4, and is disposed in a state in which the jack terminal 31 is oriented outwardly of the housing 4 through the jack insertion-mounting hole 41.

The plug fastener 100 is a member that retains the plug 2 connected to the jack 3 through pressure contact, and formed in a truncated cone shape. The plug fastener 100 is primarily equipped with a frame section 60 in a truncated cone shape that defines an external configuration of the plug fastener 100, and an elastic section 70 in a ring shape on which the frame section 60 is circularly mounted.

The frame section 60 is a portion that regulates the amount of deformation of the elastic section 70, and is made of ABS resin. Also, the frame section 60 is equipped with a mounting section 80 that is formed in one piece with the frame section 60 and protrudes outwardly in a radial direction from the outer circumferential surface of the frame section 60, and a rotation prevention section 90 that is formed in one piece with the frame section 60 and positioned on the opposite side of the mounting section 80 with the elastic section 70 interposed there between (see FIG. 3(*b*) and FIG. 4).

The mounting section 80 is a portion for fixing the plug fastener 100 to the housing 4, and is formed with a screw hole 81 for passing a screw 5 therein. The rotation prevention section 90 is a portion that restricts the plug fastener 100 from rotationally moving about the screw 5 as a pivot when the plug fastener 100 is attached to the housing 4 with the screw 5, and protrudes from a bottom surface (a surface abutted against the housing 4) of the frame section 60 to its greater diameter side (to the right side in FIG. 4).

The elastic section 70 is a portion for retaining the plug retaining section 22 through pressure contact, and is made of an elastic material such as elastomer. The elastic section 70 can be elastically deformed as the plug retaining section 22 is inserted in the elastic section 70. By this, the plug retaining section 22 can be fixed through pressure contact to the elastic section 70 by the elastic force of the elastic section 70.

Also, as the elastic section 70 is made of elastomer that is an elastic material, it is more difficult to plastically deform through repeated use, compared to the case where the elastic section 70 is made of synthetic resin such as ABS resin or the like, whereby the retaining force of the plug retaining section 22 can be maintained for an extended period of time.

For mounting the plug fastener 100, first, the rotation prevention section 90 is inserted in a rotation prevention hole 42 that is formed at a peripheral portion of the jack insertion mounting hole 41. Next, the plug fastener 100 is disposed in a manner to surround a circumferential portion of the jack insertion mounting hole 41, and is fixed to the housing 4 with the screw 5 passed through the screw hole 81. By this, the plug fastener 100 can be installed on the housing 4.

In this manner, the plug fastener 100 can be mounted on the outside of the housing 4 with the screw 5, and therefore installed irrespective of the structure of the electric device stored inside the housing 4. Therefore, the plug fastener 100 can be mounted not only in a manufacturing stage of a product, but also on a finished product later, which is effective in improving the general applicability of the plug fastener 100. Also, even when the user does not have expert knowledge about the electric device stored in the housing 4, the user himself/herself can remove the plug fastener 100, if the user does not need the plug fastener 100.

Moreover, the frame section 60 is made of ABS resin that is harder than the elastic section 70, such that the plug fastener 100 can be more firmly fixed, compared to the case of installing the elastic section 70 made of elastomer directly on the housing 4.

It is noted that, when the plug fastener 100 is installed on the housing 4, and when an error is present in coaxial accuracy among the plug fastener 100, the plug 2 and the jack 3, the elastic section 70 may be elastically deformed thereby correcting the error in the coaxiality, whereby a tolerance can be given for assembling accuracy among the parts including the plug fastener 100, the plug 2 and the jack 3. Accordingly, it is not necessary to set the coaxial accuracy to a high degree at the time of installing the frame section 60, such that the plug fastener 100 can be effectively installed.

The plug fastener 100 is formed by a two-color molding with an injection molding machine equipped with two injection device sets. More specifically, in a primary molding, a metal mold (upper mold) for primary molding is clamped to a core (lower mold), and ABS resin material is injected to form the frame section 60. Then the molds are opened. Thereafter, the frame section 60 as the primary molding with the core attached thereto is clamped to a metal mold for secondary molding, instead of the metal mold for primary molding, and elastomer material is injected therein, thereby forming the elastic section 70. By this, the plug fastener 100 that is the final molding is formed. The final molding is removed from the metal molds. At this time, the elastomer and the ABS resin material are mutually bonded together as a result of their own property, such that the elastic section 70 and the frame section 60 can be formed in one piece.

By the two-color molding, the plug fastener 100 can be formed through a single operation, such that the work efficiency in manufacturing the plug fastener 100 can be improved. Also, as the frame section 60 and the elastic section 70 are formed in one piece, the work efficiency in installing the plug fastener 100 to the housing 4 can be improved, compared to the case of individually forming the frame section 60 and the elastic section 70.

Figure 2A:
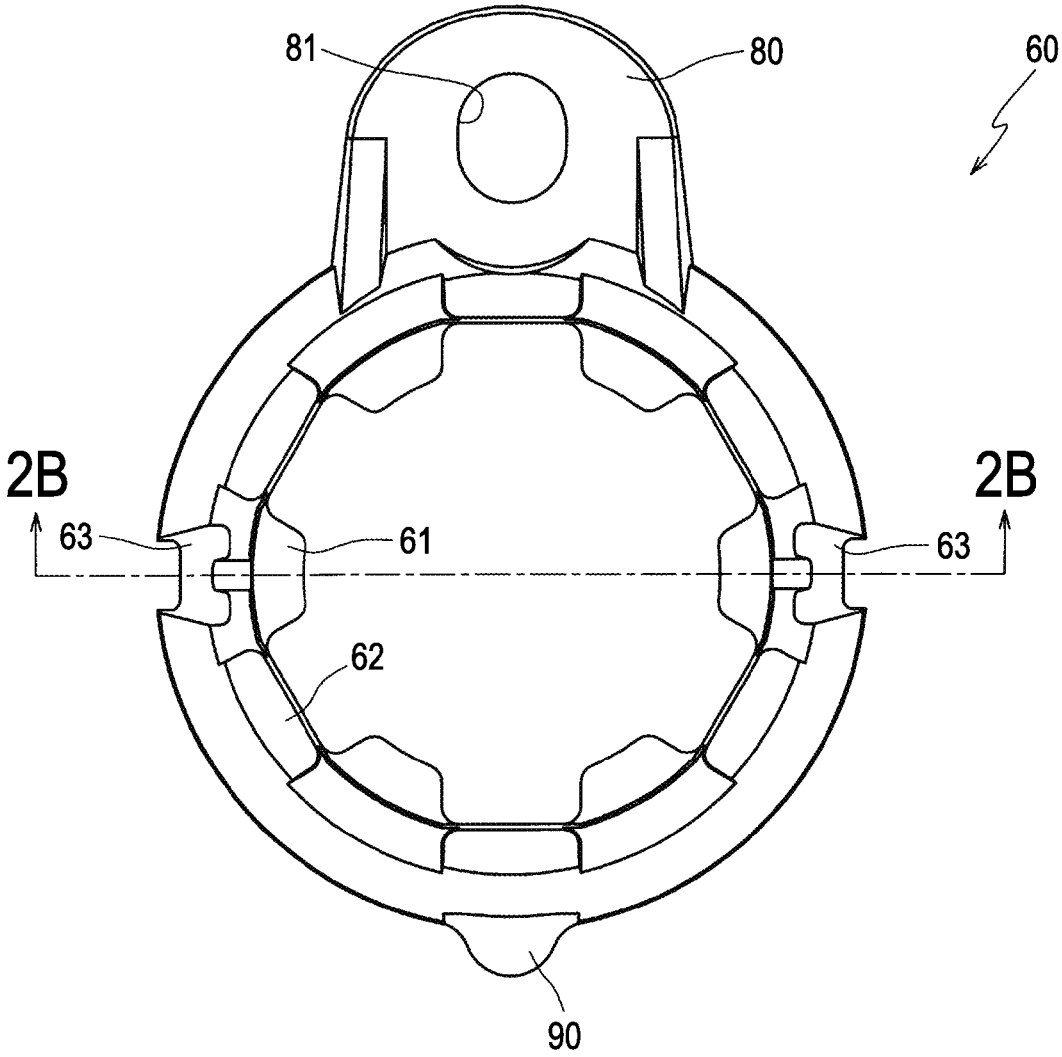
FIG. 2(*a*) is a front view of a frame section, and FIG. 2(*b*) is a cross-sectional view of the frame section taken along a line IIb-IIb in FIG. 2(*a*).
Figure 2B:
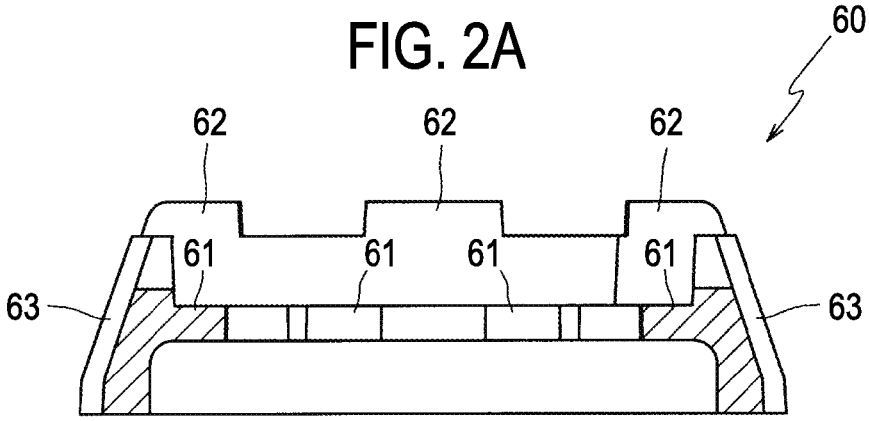

Next, referring to FIG. 2, a detailed structure of the frame section 60 is described. FIG. 2(*a*) is a front view of the frame section 60, and FIG. 2(*b*) is a cross-sectional view of the frame section 60 taken along a line IIb-IIb in FIG. 2(*a*). It is noted that the frame section 60 shown in FIG. 2(*a*) and FIG. 2(*b*) is formed by a metal mold for primary molding, which is before being formed with a metal mold for secondary molding.

As shown in FIG. 2(*a*) and FIG. 2(*b*), the frame section 60 is a member formed in a cylindrical and truncated cone shape, and is equipped with a first restriction wall 61, a second restriction wall 62 and injection grooves 63.

The first restriction wall 61 includes six portions protruding from an inner circumferential surface of the frame section 60, which is located at predetermined distances from openings on both sides of the frame section 60, in a radial inward direction of the frame section 60, and provided at regular intervals along the circumferential direction. The second restriction wall 62 includes six portions extending from an end face of the opening section on a smaller diameter side (the upper side in FIG. 2(*b*)) of the frame section 60, and provided at regular intervals along the circumferential direction. Also, in the front view shown in FIG. 2(*a*) (as viewed in the axial direction of the frame section 60), each of the second restriction walls 62 is formed between two adjacent ones of the first restriction walls 61.

Figure 3C:
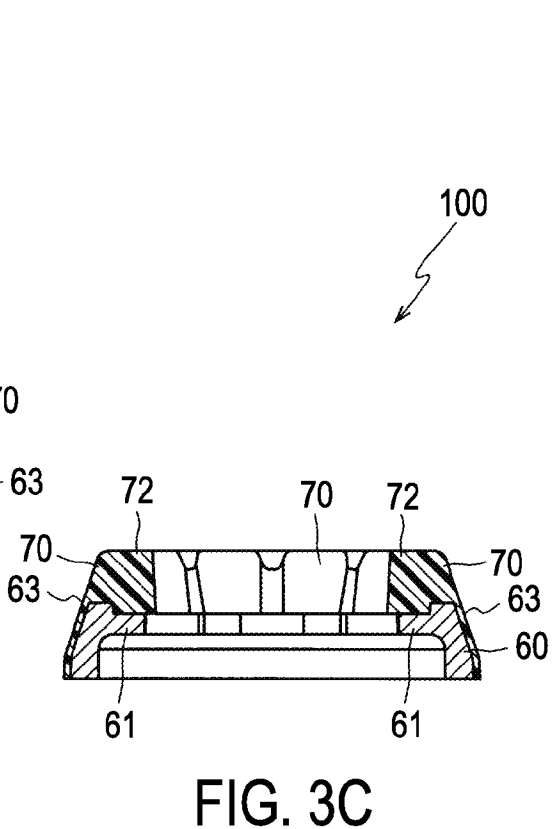
FIG. 3(*a*) is a front view of a plug fastener, FIG. 3(*b*) is a rear view of the plug fastener, and FIG. 3(*c*) is a cross-sectional view of the fastener taken along a line IIIc-IIIc in FIG. 3(*a*).
Figure 3B:
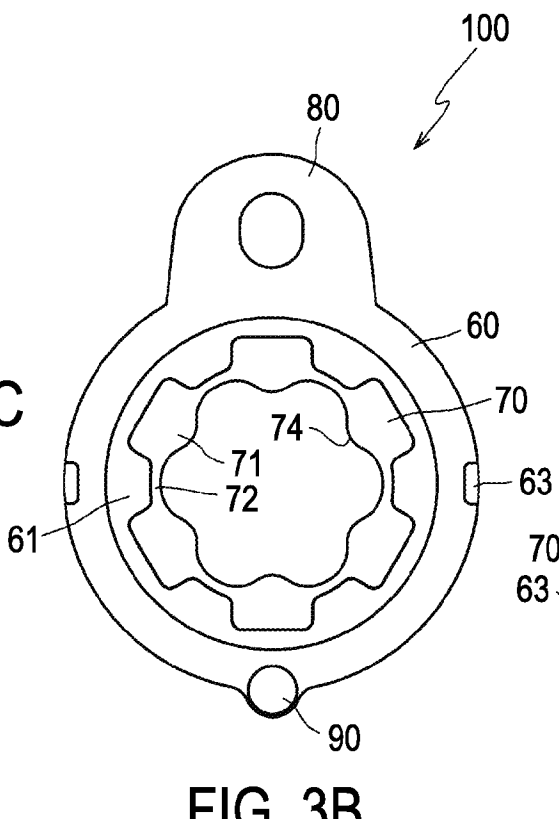
Figure 3A:
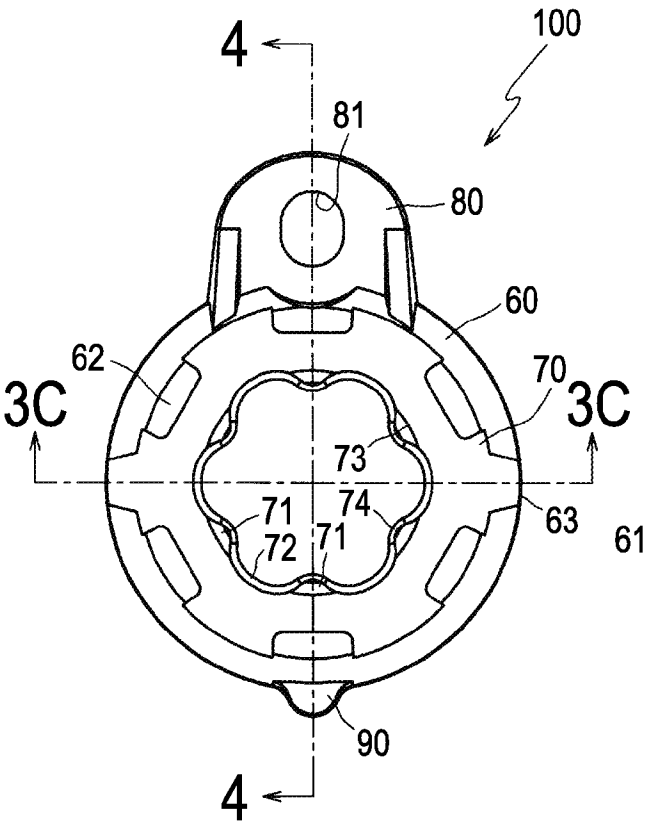

The injection grooves 63 are portions each in a groove shape for injecting elastomer material when forming the elastic section 70 (see FIG. 3(*a*)), and are formed at two places at right and left positions shifted through 90 degrees in phase from the mounting section 80.

Figure 4:
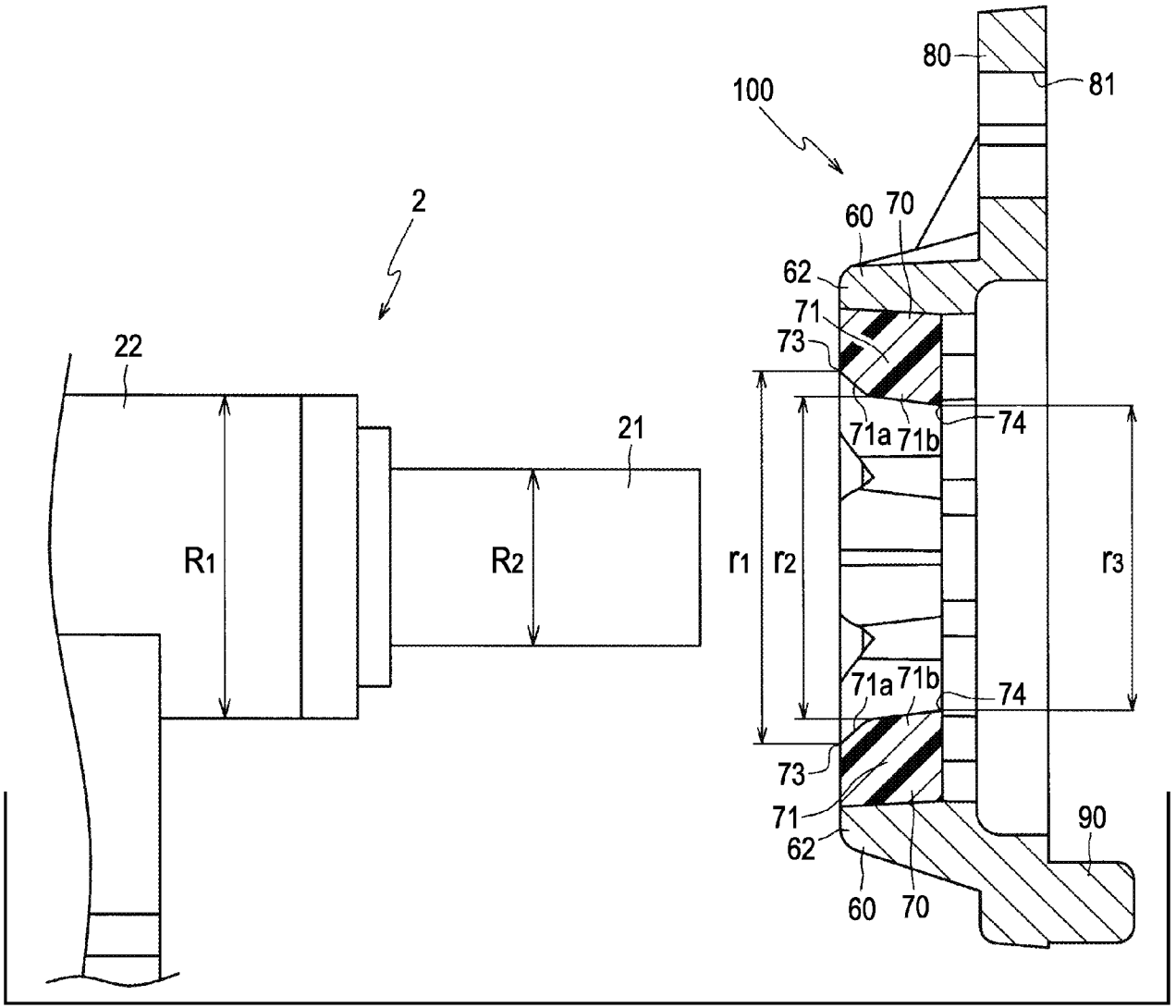
FIG. 4 is a cross-sectional view of the plug fastener taken along a line IV-IV in FIG. 3(*a*).

Next, referring to FIG. 3 and FIG. 4, a detailed structure of the elastic section 70 will be described. FIG. 3(*a*) is a front view of the plug fastener 100, FIG. 3(*b*) is a rear view of the plug fastener 100, and FIG. 3(*c*) is a cross-sectional view of the plug fastener 100 taken along a line IIIc-IIIc in FIG. 3(*a*). FIG. 4 is a cross-sectional view of the plug fastener 100 taken along a line IV-IV in FIG. 3(*a*). It is noted that FIG. 4 shows a plug 2 disposed at a position corresponding to the plug fastener 100.

As shown in FIG. 3(*a*), the elastic section 70 is a ring-shaped portion in which the plug retaining section 22 (see FIG. 1(*a*)) is pressure-inserted. Also, the elastic section 70 is equipped with six elastic protrusions 71 projecting in a radial inward direction from its inner circumferential surface, provided at regular intervals along the circumferential direction. Furthermore, end faces of the elastic protrusions 71 are each formed in a generally circular arc shape as viewed in the front view (as viewed in the axial direction of the plug fastener 100) shown in FIG. 3(*a*), and a virtual circle connecting convex end sections of the end faces is formed to be smaller than a virtual circle connecting outermost exterior portions of the plug retaining section 22.

Also, the elastic section 70 is equipped with six elastic non-protruding portions 72 each formed between adjacent ones of the elastic protrusions 71, and a virtual circle connecting concave end sections of the elastic non-protruding portions 72 is formed to be greater than the virtual circle connecting outermost exterior portions of the plug retaining section 22 (see FIG. 4).

Furthermore, in the front view, the second restriction walls 62 are formed on the outer circumferential side of the elastic section 70, wherein portions thereof matching in phase with the six elastic non-protruding portions 72 are provided receded from portions thereof matching in phase with the six elastic protrusions 71 in the circumferential direction. Therefore, by adjusting the length of the second restriction walls 62 in the radial direction (the convex length in the radial inward direction), the convex length of the elastic protrusions 71 in the radial inward direction can be formed shorter. Accordingly, by adjusting the length of the second restriction walls 62 in the radial direction, the retention force of the plug retaining section 22 by the elastic section 70 can be readily increased or reduced.

Here, as shown in FIG. 3(*b*), in the rear view in FIG. 3(*b*) (as viewed in the axial direction of the plug fastener 100), the first restriction walls 61 are abutted against a bottom surface of the elastic section 70 on an installation surface side thereof (the forward side of FIG. 3(*b*)) to be installed on the housing 4. As a result, a wider bonding area can be secured between the elastic section 70 and the frame section 60, such that the elastic section 70 and the frame section 60 can be more firmly fixed together to a corresponding degree.

It is noted that the elastic section 70 is formed, in the second color molding, through injecting elastomer material in the inner circumferential side of the frame section 60 through the injection grooves 63 formed in the primary molding, and at the same time bonded mainly to the inner circumferential surface of the frame section 60.

In this instance, as shown in FIG. 3(*c*), the bottom surface side (the lower side in FIG. 3(*c*)) of the elastic section 70 and the front surface side (the upper side in FIG. 3(*c*)) of the first restriction wall 61 are mutually bonded together. By this, a wider bonding area can be secured between the elastic section 70 and the frame section 60, whereby the elastic section 70 and the frame section 60 can be more firmly bonded together.

As shown in FIG. 4, the elastic protrusions 71 include a first pressure-insertion aperture 71*a* formed at a position including the first opening 73 that is an opening for pressure-insertion (on the left side in FIG. 4) defined by one of virtual circles connecting the convex end sections of the elastic protrusions 71, and a second pressure-insertion aperture 71*b* continuous with the first pressure-insertion aperture 71*a* and formed at a position including the second opening 74 that is an opening defined by one of the virtual circles connecting the convex end sections of the elastic protrusions 71, on the side (the right side in FIG. 4) to be installed on the housing 4.

As the first opening 73 has an inner diameter r1 that is formed greater than a diameter R1 of a retaining section virtual circle that is a virtual circle connecting the outermost exterior portions of the plug retaining section 22, the end face of the plug retaining section 22 is made more difficult to contact with a peripheral portion of the first opening 73 at the time of pressure-inserting the plug retaining section 22 in the elastic section 70. Accordingly, damage to the peripheral portion of the first opening 73 that may be caused by its contacts with the plug retaining section 22 can be suppressed.

Also, as the first pressure-insertion aperture 71*a* is formed in a manner that its inner diameter gradually becomes smaller from the first opening 73 toward the second opening 74, it is possible to reduce stress on the elastic protrusions 71 which is generated when the elastic protrusions 71 are pushed against the end face of the plug retaining section 22.

In other words, for example, when the virtual circles connecting the convex end sections of the elastic protrusions 71 are formed with a portion with a first diameter that is the same as the inner diameter of the first opening 73 and a portion with a second diameter that is another diameter which is the same as the inner diameter of the second opening 74, a connecting surface between the portion with the first diameter and the portion with the second diameter faces in a direction opposing the first opening 73. Therefore, when the end face of the plug retaining section 22 is pressed against the elastic protrusions 71, the stress on the connecting surface of the elastic protrusions 71 may become substantial, which would likely damage the elastic protrusions 71.

In contrast, in accordance with the present embodiment, the diameter of the virtual circle connecting the convex end sections of the elastic protrusions 71 gradually reduces from the first opening 73 toward the second opening 74, such that the stress on the elastic protrusions 71 generated upon pressing the end face of the plug retaining section 22 against the elastic protrusions 71 can be reduced, whereby the elastic protrusions 71 are made more difficult to be damaged.

Moreover, an internal diameter r2 at the connecting section between the first pressure-insertion aperture 71*a* and the second pressure-insertion aperture 71*b* is formed to be smaller than the diameter R1 of the retaining section virtual circle, and an inner diameter r3 of the second opening 74 is formed to be smaller than the diameter R1 of the retaining section virtual circle and greater than an outer diameter R2 of the plug terminal 21. Also, the inner diameter of the second pressure-insertion aperture 71*b* is formed in a manner to gradually become smaller from the connecting section between the first pressure-insertion aperture 71*a* and the second pressure-insertion aperture 71*b* toward the second opening 74. Also, the rate of gradual reduction in the inner diameter of the second pressure-insertion aperture 71*b* is made to be smaller than the rate of gradual reduction in the inner diameter of the first pressure-insertion aperture 71*a* (in other words, the inclination thereof with respect to the axis of the elastic section 70 becomes smaller).

Let us compare the present embodiment with a case in which the opening area of the first opening 73 and the opening area of the second opening 74 are made to have the same sizes as those of the present embodiment, and the diameter is gradually reduced at a constant rate from the first opening 73 to the second opening 74. According to the present embodiment, the second pressure-insertion aperture 71*b* is formed smaller than the diameter R1 of the retaining section virtual circle, a wider contact area can accordingly be secured between the plug retaining section 22 and the elastic protrusions 71, compared to the case where the diameter is gradually reduced at a constant rate from the first opening 73 to the second opening 74.

In particular, in accordance with the present embodiment, the length in the axial direction (right-left direction in FIG. 4) of the second pressure-insertion aperture 71*b* is formed to be longer than the length in the axial direction of the first pressure-insertion aperture 71*a*. Therefore, a wider contact area can be secured between the plug retaining section 22 and the elastic protrusions 71, compared to the case where the length in the axial direction of the second pressure-insertion aperture 71*b* is made shorter than the length in the axial direction of the first pressure-insertion aperture 71*a*. Therefore, the plug retaining section 22 can be more firmly fixed through pressure contact.

Accordingly, the first pressure-insertion aperture 71*a* makes it difficult for the end face of the plug retaining section 22 and the peripheral portion of the first opening 73 to contact each other, and the second pressure-insertion aperture 71*b* makes it possible for the plug retaining section 22 to be more securely fixed through pressure contact.

Figure 5:
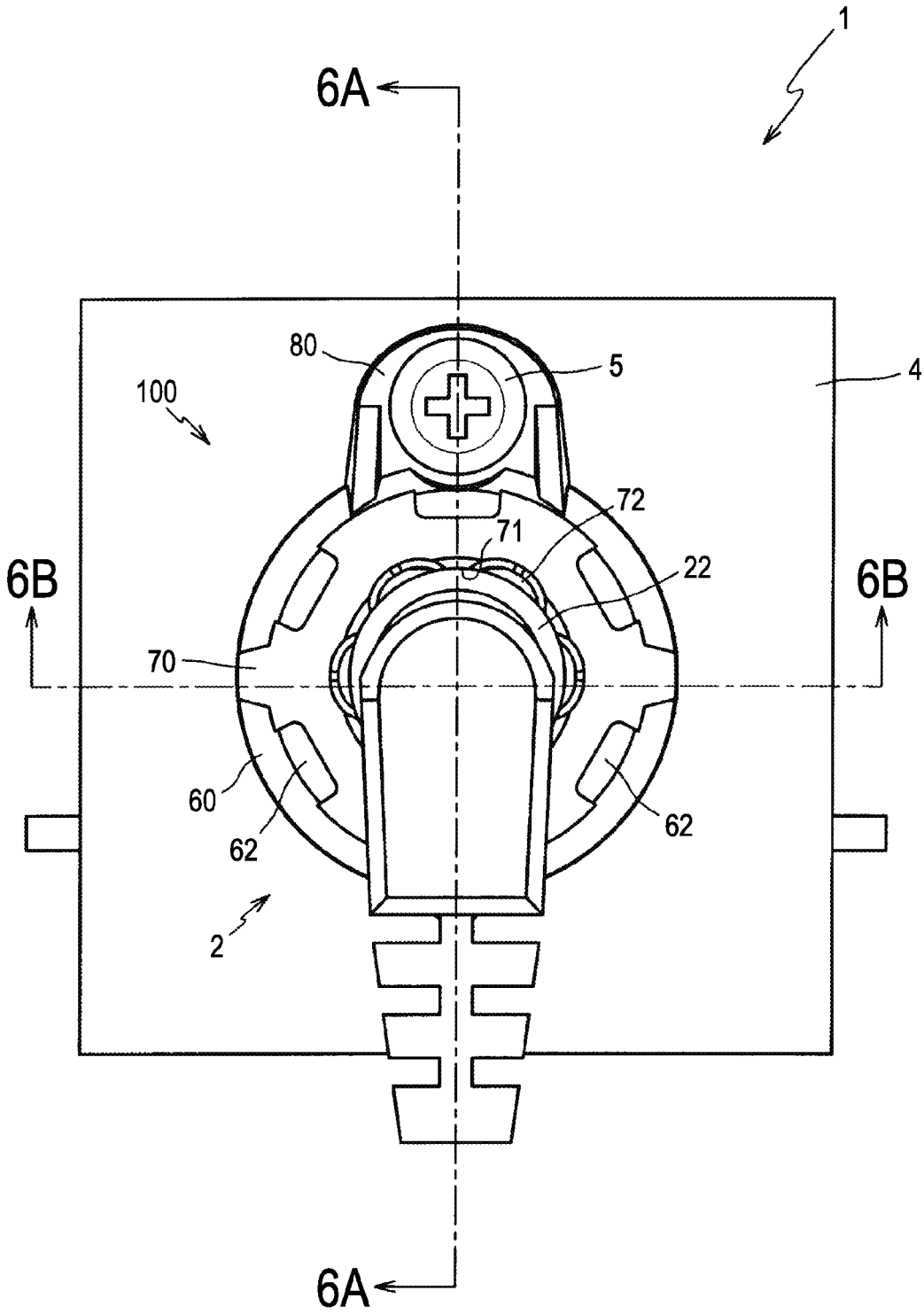
FIG. 5 is a front view of the plug detachment prevention structure in a state in which a plug is pressure-inserted.
Figure 6A:
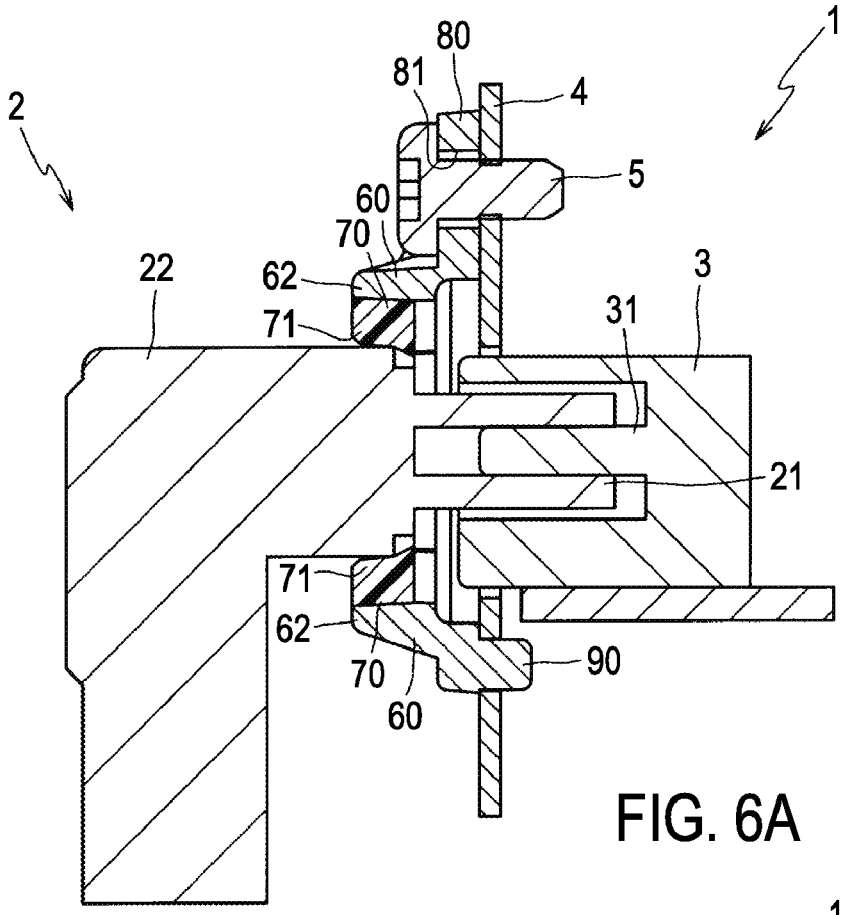
FIG. 6(*a*) is a cross-sectional view of the plug detachment prevention structure taken along a line VIa-VIa in FIG. 5, and FIG. 6(*b*) is a cross-sectional view of the plug detachment prevention structure taken along a line VIb-VIb in FIG. 5.
Figure 6B:
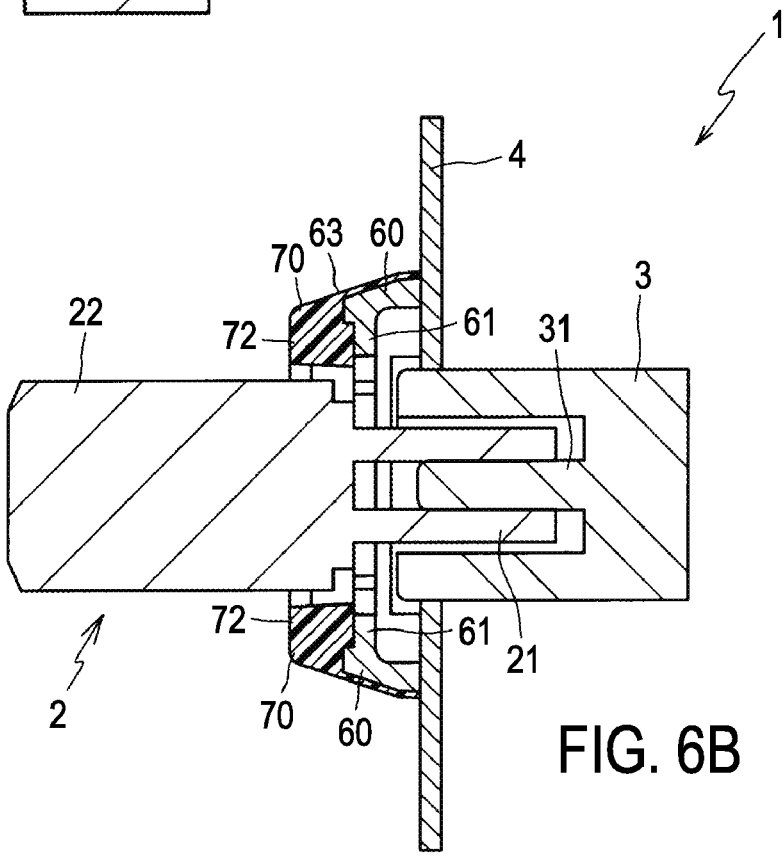

Next, referring to FIG. 5 and FIG. 6, a method of fixing the plug 2 with the plug fastener 100 will be described. FIG. 5 is a front view of the plug detachment prevention structure 1 in a state in which the plug 2 is pressure-inserted. FIG. 6(*a*) is a cross-sectional view of the plug detachment prevention structure 1 taken along a line VIa-VIa in FIG. 5, and FIG. 6(*b*) is a cross-sectional view of the plug detachment prevention structure 1 taken along a line VIb-VIb in FIG. 5. It is noted that FIGS. 5 and 6 show a state in which the plug 2 is inserted in the jack 3 halfway through in an insertion direction (to the right in FIG. 6(*a*)).

As the elastic section 70 is made of elastomer, and the portion among the elastic protrusions 71 forming the second pressure-insertion aperture 71*b* (see FIG. 4) is formed to be smaller than the outermost exterior portion of the plug retaining section 22, the plug 2 is retained by the plug fastener 100 mounted on the housing 4 through pressure contact when the plug retaining section 22 is pressure-inserted in the elastic section 70, as shown in FIG. 5.

In this instance, as viewed from the front side, the six elastic protrusions 71 abut against the second restriction walls 62, respectively. Therefore, deformation of the elastic protrusions 71 in the radial inward direction can be restricted by the second restriction walls 62, whereby the elastic section 70 can firmly retain the plug retaining section 22 through pressure contact.

On the other hand, portions of the second restriction wall 62 matching in phase with the six elastic non-protruded sections 72 in the circumferential direction are receded more than portions thereof matching in phase with the six elastic protrusions 71 in the circumferential direction. This makes it easier for the elastic protrusions 71 to elastically deform to the sides where the elastic non-protruded sections 72.

Moreover, as viewed from the front side (the forward side in FIG. 5), the elastic non-protruded sections 72 each formed between adjacent ones of the elastic protrusions 71 are not brought in pressure contact with the outer circumferential surface of the plug retaining section 22. By this, a space is formed between adjacent ones of the elastic protrusions 71, whereby the elastic protrusions 71 would more readily elastically deform to the sides where the elastic non-protruded sections 72 are arranged.

Therefore, when an error is present in coaxial accuracy among the plug fastener 100, the plug 2 and the jack 3, as the elastic protrusions 71 would more readily elastically deform, a wider range can be secured accordingly for correction of errors in coaxiality among the plug fastener 100, the plug 2 and the jack 3.

As shown in FIG. 6(*a*) or FIG. 6(*b*), the first restriction wall 61 is abutted against the bottom surface of the elastic section 70 on its installation surface side with respect to the housing 4 (on the right side in FIG. 6(*b*)), whereby the amount of elastic deformation of the elastic section 70 toward the side of the housing 4 (to the right side in FIG. 6(*b*)) can be restricted by the first restriction wall 61, when the plug retaining section 22 is pressure-inserted in the elastic section 70. More specifically, when the elastic section 70 elastically deforms toward the housing 4, the restoring force of the elastic section 70 acts as a force that pushes back the plug terminal 21 connected to the jack 3 to the side of the plug retaining section 22 (to the left side in FIG. 6(*b*)). In contrast, in accordance with the described embodiments, the amount of elastic deformation of the elastic section 70 toward the housing 4 is restricted by the first restriction wall 61, such that the restoring force of the elastic section 70 can be suppressed to a corresponding degree, which can prevent the plug 2 from separating from the jack 3.

On the other hand, the six first restriction walls 61 are formed at positions matching in phase with the six elastic non-protruded sections 72 in the circumferential direction, respectively. Therefore, when the plug fastener 100 is formed by a two-color molding, it is possible to avoid bonding between the bottom surface of the elastic protrusions 71 on the installation surface side with respect to the housing 4 and the first restriction wall 61. Accordingly, it is possible to prevent elastic deformation of the elastic protrusions 71 from being restricted due to bonding with the first restriction wall 61.

Therefore, at the time of pressure-inserting the plug retaining section 22 in the elastic section 70, elastic deformation of the elastic section 70 toward the housing 4 is controlled and the elastic protrusions 71 are made to be more readily elastically deformed, such that the plug retaining section 22 can be securely fixed through pressure contact.

Figure 7:
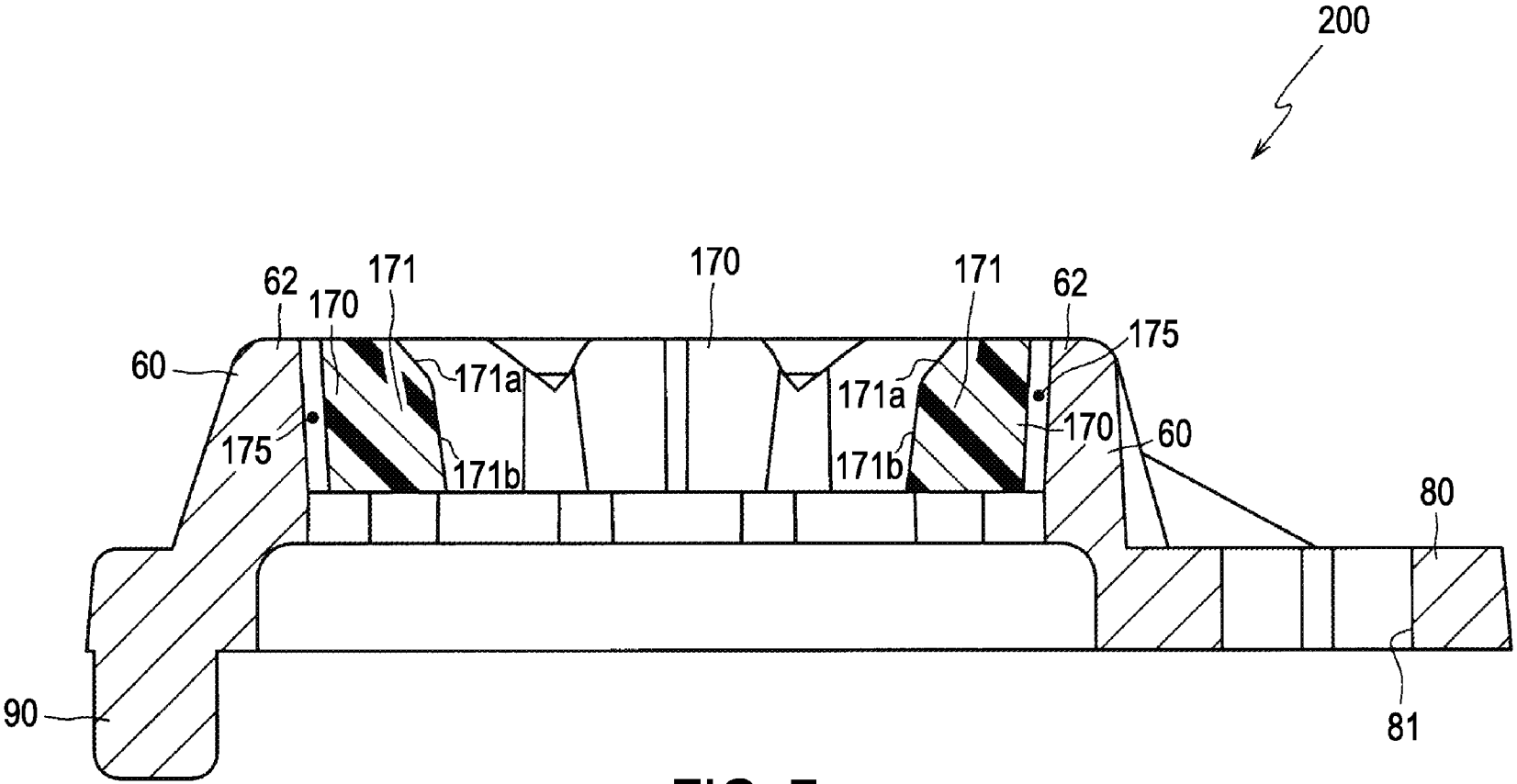
FIG. 7 is a cross-sectional view of a plug fastener in accordance with a second embodiment.

Next, referring to FIG. 7, a second embodiment will be described. The first embodiment has been described as to the case where, as viewed from the front side, the six elastic protrusions 71 and the second restriction wall 62 are mutually abutted on each other. In accordance with the second embodiment, a gap 175 with a predetermined separation is formed between six elastic protrusions 171 and the second restriction wall 62. It is noted that parts identical with those in the first embodiment described above will be appended with the same reference numbers, and their description shall be omitted. FIG. 7 is a cross-sectional view of a plug fastener 200 in accordance with the second embodiment. It is noted that FIG. 7 is a cross-sectional view corresponding to FIG. 4.

As shown in FIG. 7, the plug fastener 200 in accordance with the second embodiment has a gap 175 formed between the elastic protrusions 171 and the second restriction wall 62. By this, readiness of elastic deformation of the elastic protrusions 171 in the radial direction can be divided in two stages.

More specifically, in an initial stage of pressure-insertion of the plug retaining section 22 (see FIG. 6(*a*)) into the elastic section 170, deformation of the elastic protrusions 171 in the radial direction is not restricted by the second restriction wall 62 because the gap 175 remains between the elastic protrusions 171 and the second restriction wall 62. Accordingly, the elastic protrusions 171 can readily be deformed in the radial direction, which makes it easier for the plug retaining section 22 be to pressure-inserted in the elastic section 170.

Thereafter, when the plug retaining section 22 is pressure-inserted in the elastic section 170, and the elastic protrusions 171 are deformed in the radial direction by a predetermined amount, the gap 175 between the elastic protrusions 171 and the second restriction wall 62 is eliminated and the elastic protrusions 171 are brought in contact with the second restriction wall 62. As a result, as the plug retaining section 22 is retained by the elastic section 170 through pressure contact, elastic deformation of the elastic protrusions 171 in the radial direction can be restricted, whereby the plug retaining section 22 can be securely retained through pressure contact.

The invention has been described above based on some embodiments, but the invention is not limited to the embodiments described above, and it can be readily predicted that many modifications and changes can be made within the range that does not depart from the subject matter of the invention.

For example, in each of the embodiments described above, the description is made as to the case where the frame section 60 and the elastic section 70, 170 are formed in one piece by a two-color molding. However, without being limited to the above, the frame section 60 and the elastic section 70, 170 may be formed individually, and the frame section 60 and the elastic section 70, 170 may be bonded or assembled when they are installed on the housing 4.

Furthermore, in each of the embodiments described above, a single mounting section 80 is provided in a protruding manner on the external circumferential surface of the frame section 60. However, without being limited to this, two or more mounting sections 80 may be provided in a protruding manner. By this, the plug fastener 100 can be more strongly installed on the housing 4.

Also, in each of the embodiments described above, the elastic section 70, 170 is equipped with the elastic protrusions 71, 171. However, without being limited to the above, the inner circumferential surface of the elastic section 70, 170 may be formed in a circular shape as viewed in the axial direction. By this, when the plug retaining section 22 is pressure-inserted in the elastic section 70, 170, a wider contact surface can be secured between the plug retaining section 22 and the elastic section 70, 170, whereby the plug retaining section 22 can be more strongly fixed through pressure contact.

Moreover, in each of the embodiments described above, the frame section 60 includes the second restriction walls 62 formed at six places at regular intervals in the circumferential direction. However, without being limited to the above, the second restriction wall 62 may be formed entirely along the circumferential direction. By this, the amount of elastic deformation of the elastic protrusions 71, 171 to the sides where the elastic non-protruded sections 72 are disposed can be more securely restricted.

Furthermore, in each of the embodiments described above, the elastic protrusions 71, 171 are equipped with the first pressure-insertion aperture 71*a*, 171*a*, and the second pressure-insertion aperture 71*b*, 171*b*, and the rate in which the inner diameter of the second pressure-insertion aperture 71*b*, 171*b* becomes gradually smaller from the first opening 73 toward the second opening 74 is made to be smaller than the rate in which the inner diameter of the first pressure-insertion aperture 71*a*, 171*a* becomes gradually smaller. However, without being limited to the above, it may be sufficient if the virtual circle connecting convex end sections of the elastic protrusions 71, 171 becomes gradually smaller from the first opening 73 to the second opening 74.

It is noted that the plug 2 is provided for transmission and reception of electrical signals, power supply and the like with respect to the electric device stored in the housing 4.

The invention claimed is:

1. A plug detachment prevention structure, in which, when a plug equipped with a plug terminal and a plug retaining section that covers a part of the plug terminal is connected to a jack provided inside a housing, the plug detachment prevention structure retains the plug retaining section to prevent the plug from detaching from the jack, the plug detachment prevention structure characterized in comprising:

a ring-shaped elastic section composed of an elastic material in which the plug retaining section is pressure-inserted; and a frame section that is circularly mounted along an outer circumferential side of the elastic section, composed of a material harder than that of the elastic section and detachably attached on an outside of the housing, wherein the frame section abuts the elastic section along the outer circumferential side of the elastic section when the plug retaining section is pressure inserted in the ring shaped elastic section.

2. The plug detachment prevention structure of claim 1, wherein the elastic section is equipped with a plurality of elastic protrusions that protrude from an inner circumferential surface side in a radial inward direction and are brought in pressure contact with an outer circumferential surface of the plug retaining section, and a plurality of elastic non-protruded sections, each being formed between adjacent ones of the elastic protrusions as viewed in an axial direction, and having concave end sections, wherein an outer circumference of the concave end sections has a greater diameter than a diameter of a plug circumference of outermost exterior portions of the plug retaining section.

3. A plug detachment prevention structure, in which, when a plug equipped with a plug terminal and a plug retaining section that covers a part of the plug terminal is connected to a jack provided inside a housing, the plug detachment prevention structure retains the plug retaining section to prevent the plug from detaching from the jack, the plug detachment prevention structure characterized in comprising:

a ring-shaped elastic section composed of an elastic material in which the plug retaining section is pressure-inserted, wherein the elastic section is equipped with a plurality of elastic protrusions that protrude from an inner circumferential surface side in a radial inward direction and are brought in pressure contact with an outer circumferential surface of the plug retaining section, and a plurality of elastic non-protruded sections, each being formed between adjacent ones of the elastic protrusions as viewed in an axial direction, and having concave end sections, wherein an outer circumference of the concave end sections has a greater diameter than a diameter of a plug circumference of outermost exterior portions of the plug retaining section; and a frame section that is circularly mounted at an outer circumferential side of the elastic section, composed of a material harder than that of the elastic section and detachably attached on an outside of the housing, wherein the frame section is equipped with a restriction wall that protrudes from an inner circumferential side in a radial inward direction, and is abutted against a bottom surface of the elastic section on an installation surface side thereof with respect to the housing.

4. The plug detachment prevention structure of claim 3, wherein the restriction wall comprises a plurality of restriction walls formed in a circumferential direction at predetermined intervals, and the plurality of restriction walls are formed at positions matching in phase with the plurality of elastic non-protruded sections in the circumferential direction.

5. The plug detachment prevention structure of claim 3, wherein the restriction wall comprises a first restriction wall, wherein the frame section is equipped with a second restriction wall that is formed on the outer circumferential side of the elastic section as viewed in an axial direction, wherein portions thereof matching in phase with the plurality of elastic non-protruded sections in the circumferential direction are more receded than portions thereof matching in phase with the plurality of elastic protrusions in the circumferential direction.

6. The plug detachment prevention structure recited in claim 5, wherein the elastic section has a gap having a predetermined separation between the elastic protrusions and the second restriction wall.

7. A plug detachment prevention structure, in which, when a plug equipped with a plug terminal and a plug retaining section that covers a part of the plug terminal is connected to a jack provided inside a housing, the plug detachment prevention structure retains the plug retaining section to prevent the plug from detaching from the jack, the plug detachment prevention structure characterized in comprising:

a ring-shaped elastic section composed of an elastic material in which the plug retaining section is pressure-inserted, wherein the elastic section is equipped with a plurality of elastic protrusions that protrude from an inner circumferential surface side in a radial inward direction and are brought in pressure contact with an outer circumferential surface of the plug retaining section, and a plurality of elastic non-protruded sections, each being formed between adjacent ones of the elastic protrusions as viewed in an axial direction, and having concave end sections, wherein an outer circumference of the concave end sections has a greater diameter than a diameter of a plug circumference of outermost exterior portions of the plug retaining section; and a frame section that is circularly mounted at an outer circumferential side of the elastic section, composed of a material harder than that of the elastic section and detachably attached on an outside of the housing, wherein the elastic section is formed such that, among an outer circumference of convex end sections of the elastic protrusions, a first opening that is an opening for pressure-insertion of the plug has an inner diameter formed to be greater than that of the plug circumference, and among the outer circumference of the convex end sections of the elastic protrusions, a second opening on the side thereof to be attached to the housing has an inner diameter smaller than that of the plug circumference, and greater than an outer diameter of the plug terminal, wherein the outer circumference of the convex end sections of the elastic protrusions gradually become smaller from the first opening toward the second opening.

8. The plug detachment prevention structure recited in claim 7, wherein the elastic section is equipped with a first pressure-insertion aperture formed at a position including the first opening, and a second pressure-insertion aperture continuous with the first pressure-insertion aperture and formed at a position including the second opening, wherein the rate of gradual reduction in the inner diameter of the second pressure-insertion aperture is smaller than the rate of gradual reduction in the inner diameter of the first pressure-insertion aperture, and the inner diameter at a connection section between the first pressure-insertion aperture and the second pressure-insertion aperture is formed to be smaller than that of the plug circumference.

9. The plug detachment prevention structure recited in claim 8, wherein the elastic section is formed to have a length longer in the axial direction in the second pressure-insertion aperture than a length in the axial direction in the first pressure-insertion aperture.

10. A plug detachment prevention structure, in which, when a plug equipped with a plug terminal and a plug retaining section that covers a part of the plug terminal is connected to a jack provided inside a housing, the plug detachment prevention structure retains the plug retaining section to prevent the plug from detaching from the jack, the plug detachment prevention structure characterized in comprising:

a ring-shaped elastic section composed of an elastic material in which the plug retaining section is pressure-inserted;

a plurality of elastic protrusions projecting in a radial inward direction from an inner surface of the ring-shaped elastic section;

a first opening defined by the elastic protrusions for pressure insertion having a first inner diameter greater than a diameter of the plug retaining section and a second inner diameter smaller than the diameter of the plug retaining section; and a second opening continuous with the first opening having a third inner diameter smaller than the diameter of the plug retaining section and greater than an outer diameter of the plug terminal.

11. The plug detachment prevention structure of claim 10, further comprising:

a first pressure insertion aperture defined by the elastic protrusions and formed at the first opening; and a second pressure insertion aperture defined by the elastic protrusions and formed at the second opening, wherein the second pressure insertion aperture is continuous with the first pressure insertion aperture.

12. The plug detachment prevention structure of claim 11, wherein the first pressure insertion aperture has the first inner diameter at the first opening, and wherein the first pressure insertion aperture is formed to have an inner diameter that gradually becomes smaller from the first opening to the second opening.

13. The plug detachment prevention structure of claim 12, wherein a connection section between the first pressure insertion aperture and the second pressure insertion aperture has the second internal diameter.

14. The plug detachment prevention structure of claim 13, wherein the second pressure insertion aperture is formed to have an inner diameter that gradually becomes smaller from the connection section toward the second opening.

15. The plug detachment prevention structure of claim 14, wherein a first rate of gradual reduction in the inner diameter of the first pressure insertion aperture is greater than a second rate of gradual reduction in the inner diameter of the second pressure insertion aperture.

16. A plug detachment prevention structure, in which, when a plug equipped with a plug terminal and a plug retaining section that covers a part of the plug terminal is connected to a jack provided inside a housing, the plug detachment prevention structure retains the plug retaining section to prevent the plug from detaching from the jack, the plug detachment prevention structure characterized in comprising:

a ring-shaped elastic section composed of an elastic material in which the plug retaining section is pressure-inserted;

a plurality of elastic protrusions projecting in a radial inward direction from an inner surface of the ring-shaped elastic section;

first restriction walls abutted against a bottom surface of the elastic section, wherein an amount of elastic deformation of the elastic section toward a side of the housing is restricted by the first restriction walls when the plug retaining section is pressure inserted in the elastic section; and second restriction walls formed on an outer circumferential side of the elastic section, wherein the second restriction walls restrict a deformation of the elastic protrusions.

17. The plug detachment prevention structure of claim 16, wherein the second restriction walls and the elastic protrusions mutually abut on each other when the plug retaining section is not pressure inserted in the elastic section.

18. The plug detachment prevention structure of claim 16, wherein a gap is formed between the elastic protrusions and the second restriction walls.

19. The plug detachment prevention structure of claim 18, wherein during pressure insertion of the plug retaining section in the elastic section, the gap decreases to a point where the gap is eliminated and the elastic protrusions are brought into contact with the second restriction walls.

20. The plug detachment prevention structure of claim 16, further comprising:

portions of the second restriction walls matching in phase with non-protruding portions of the elastic portion between the elastic protrusions.

* * * * *